US007703511B2

(12) United States Patent
Buyers et al.

(10) Patent No.: US 7,703,511 B2
(45) Date of Patent: Apr. 27, 2010

(54) PRESSURE BARRIER APPARATUS

(75) Inventors: Mark Buyers, Aberdeen (GB); David Forsyth, Aberdeen (GB)

(73) Assignee: Omega Completion Technology Limited (GB)

( * ) Notice: Subject to any disclaimer, the term of this patent is extended or adjusted under 35 U.S.C. 154(b) by 137 days.

(21) Appl. No.: 11/859,060

(22) Filed: Sep. 21, 2007

(65) Prior Publication Data

US 2008/0073075 A1 Mar. 27, 2008

(30) Foreign Application Priority Data

Sep. 22, 2006 (GB) ..... 0618687.8

(51) Int. Cl.
*E21B 33/00* (2006.01)
*E21B 29/00* (2006.01)

(52) U.S. Cl. ..... 166/192; 166/179; 166/376; 166/386; 251/181

(58) Field of Classification Search ..... 166/179, 166/192, 376, 386; 251/181
See application file for complete search history.

(56) References Cited

U.S. PATENT DOCUMENTS 5,479,986 A * 1/1996 Gano et al. ..... 166/292
5,607,017 A * 3/1997 Owens et al. ..... 166/288
5,765,641 A * 6/1998 Shy et al. ..... 166/292
6,076,600 A 6/2000 Vick, Jr. et al.
6,119,783 A * 9/2000 Parker et al. ..... 166/386
6,220,350 B1 * 4/2001 Brothers et al. ..... 166/192
6,431,276 B1 8/2002 Robb et al.

FOREIGN PATENT DOCUMENTS

EP 0775804 5/1997

OTHER PUBLICATIONS

UK Search Report dated Jan. 18, 2008, Application No. GB0718455.9.

* cited by examiner

*Primary Examiner*—Jennifer H Gay
*Assistant Examiner*—Michael Wills, III
(74) *Attorney, Agent, or Firm*—Jack Schwartz & Associates PLLC..

(57) ABSTRACT

A pressure barrier apparatus 2 for providing a removable pressure barrier in a borehole is described. The apparatus comprises a housing 6, 8 defining a central bore 10 having a first part 20 and a second part 22 separated by an erodeable pressure barrier member 18. The housing also defines a second fluid flow passage 12 for connecting the first part to the second part, and a plurality of conduits 24 for directing fluid onto the barrier member. A sleeve 30 has a first condition in which fluid communication between the first part 20 and the second fluid flow passage 12 is prevented, and a second condition in which fluid is permitted to flow from the first part to the second fluid flow passage to cause erosion of the barrier member.

11 Claims, 3 Drawing Sheets

PRESSURE BARRIER APPARATUS

FIELD OF THE INVENTION

The present invention relates to a pressure barrier apparatus, and relates particularly, but not exclusively, to a pressure barrier apparatus for use in the oil and gas industry.

BACKGROUND OF THE INVENTION

In the oil and gas industries, hydrocarbons are obtained from deep in the earth by drilling wells into the ground to access the hydrocarbons. The hydrocarbons are contained in pores in permeable rock which is situated deep in the ground which must be drilled through in order to access the hydrocarbons. Following the drilling phase, the well is clad with a metal casing in order to support the rock and prevent the hole from collapsing. An additional metal tube which is smaller in diameter than the casing, usually of a fixed diameter, provides a conduit to contain the hydrocarbons in a pressure tight environment from near the bottom of the well to the surface.

At the surface, the metal tube (known as tubing) is terminated in a well head which features a number of valves to allow pressure and flow control of the hydrocarbons. At the bottom of the well, a packer prevents pressure from entering the void between the casing and the tubing. The packer is usually conveyed into the well along with the tubing during the well construction phase.

In the past, most wells have been drilled vertically, but technology now allows the drilling of what is termed "horizontal" wells. Wells are often deviated from a vertical direction to a high angle in order to access a large area from a central drilling point or to access remote pockets of hydrocarbons. Development of this technology has allowed horizontal drilling to evolve whereby the well is deliberately angled at up to 90 degrees when it passes through the hydrocarbon bearing rock, in order to maximise the contact area between the well and the hydrocarbon producing area. Not only does this improve the productivity of the well, but it increases the effective drainage area where the well is positioned.

One problem associated with operating at high deviations, or at 90 degrees to the vertical, is the absence of gravity to assist the process of lowering tools and instruments into the well. During the drilling phase, this is not a problem since the pipe which is used to drill the well may be pushed down the well and into the deviated section. During the latter stages of well construction, temporary pressure barriers are placed and removed using wireline techniques whereby tools and equipment are lowered down the well and positioned on the end of a wire. The wire may be of two types, slickline or electric line, both of which are spooled on a drum which may be rotated in and out. The tools are conveyed into the well assisted by gravity only, and will halt when a certain angle of deviation is reached, normally somewhere between 65 and 75 degrees.

Packers which are conveyed into the well on the tubing usually require the end of the tubing to be closed off so that pressure may be applied internally to set the packer. This also serves the purpose of checking the pressure integrity of the tubing before production start up. Occasionally, this pressure barrier is left in the well for some time to allow commissioning work to be undertaken at surface or on other adjacent wells. During this time, a drilling rig may be repositioned or removed for operational reasons. Normally the pressure barrier (also known as a plug) is removed using wireline techniques.

It is advantageous for the temporary pressure barrier to be left downhole but opened or bypassed by being operated remotely from the surface and without any sort of well intervention. This option is especially attractive if either it is in a highly deviated section of the well, if the well has been suspended for some time, or if the well is a sub-sea completion and no surface facilities exist. Additionally, such devices remove the requirement for well intervention in normal wells, thus saving time and cost.

A number of devices exist which provide this operational functionality. For example, pressure barriers may take the form of a ball valve, a glass disc or more recently a solid plug of a salt and sand compound. Actuation of all of these may be performed by a repeated pressure cycling to stress, and ultimately break, a retaining member, by application of pressure to overcome a shear disc or shear pins, initiation of a small explosive charge following recognition of an applied pressure signal, multi pressure cycles advancing a ratchet mechanism to allow actuating pressure ingress, or a combination of more than one of these. A wide range of actuation methods and procedures have been established in a variety of other downhole tools.

One type of plug apparatus is disclosed in U.S. Pat. No. 6,076,600, and relies on fresh water stored in the tool contacting a plug compound consisting of sand and salt, and dissolving the salt element following the actuation process. This tool has the advantage that the salt plug disappears following correct operation, but is easily disposable in the event of failure. However, this tool is also prone to failure through insufficient dissolution of the salt plug by the fresh water stored in the tool.

In addition, all of the above devices suffer from the disadvantage that failure of operation requires intervention into the well to remedy the problem, which is usually expensive, as a rig is usually required and time will be spent not only in the remedial work, but in mobilising and demobilising the rig. In addition, some of the above systems have been found to partially function, and in the case of ball valves, to only partially open. This provides the further disadvantage of constricting the flow and may also prevent access to a lower section of the well at a later date. Furthermore, a complete failure of a ball valve whereby it fails to open requires that the ball be milled out, which is a very expensive and time consuming operation which also threatens the integrity of the well, and is therefore to be avoided.

Preferred embodiments of the present invention seek to overcome one or more of the above disadvantages of the prior art.

SUMMARY OF THE INVENTION

According to an aspect of the present invention, there is provided a pressure barrier apparatus for providing a removable pressure barrier in a borehole, the apparatus comprising:

a housing defining a first flow passage having a first part and a second part separated in use by an erodeable pressure barrier member, a second fluid flow passage for connecting said first part to said second part, and at least one conduit for directing at least a portion of fluid flowing in said second fluid flow passage onto said barrier member to cause erosion thereof.

By providing a second fluid flow passage for connecting the first part of the first fluid flow passage to the second part, and at least one conduit for directing at least a portion of fluid flowing in said second fluid flow passage onto the barrier member to cause erosion thereof, this provides the advantage of ensuring more reliable removal of the barrier member than in prior art tools. In particular, since fluid flowing in the second flow passage becomes turbulent and is more effective to erode the barrier member, this provides the advantage that the composition of the fluid directed into contact with the barrier member has less importance than in the prior art tools.

The housing may define a constriction for receiving the barrier member.

This provides the advantage of enabling the barrier member to be more securely located in the housing, as a result of which the apparatus can withstand greater pressures before actuation thereof compared with prior art tools.

At least one said conduit may be inclined relative to a longitudinal axis of the housing.

This provides the advantage of enhancing the effect of the fluid flow to erode the barrier member.

At least one said conduit may comprise a slot.

The apparatus may further comprise an actuator mechanism having a first condition in which fluid communication between said first part and said second fluid flow passage is prevented, and a second condition in which fluid is permitted to flow from said first part to said second fluid flow passage to cause erosion of said barrier member.

In a preferred embodiment, the actuator mechanism comprises a sleeve having at least one aperture therethrough, wherein the sleeve is moveable between a first position in which fluid communication is established between the first part and the second fluid flow passage via at least one said aperture, and a second position in which fluid flow between the first part and the second fluid flow passage is prevented.

The apparatus may further comprise an erodeable barrier member for blocking the first fluid flow passage between said first part and said second part.

An external profile of the barrier member may match an internal profile of said constriction.

This provides the advantage of enabling the apparatus to withstand higher pressures.

The barrier member may comprise sand and a bonding agent.

The apparatus may further comprise a sealing membrane separating the barrier member from the first part.

This provides the advantage of minimising the risk of erosion of the barrier member before actuation of the apparatus.

The apparatus may further comprise a sealing membrane separating the barrier member from the second part.

According to another aspect of the present invention, there is provided a removable pressure barrier apparatus for location in a borehole, the apparatus comprising a housing defining a fluid flow path, and a pressure barrier member adapted to block fluid flow in said flow path and to be eroded by means of fluid flow to permit fluid flow in said flow path.

BRIEF DESCRIPTION OF THE DRAWING FIGURES

A preferred embodiment of the invention will now be described, by way of example only and not in any limitative sense, with reference to the accompanying drawings, in which.

DETAILED DESCRIPTION OF THE INVENTION

Figure 1A:
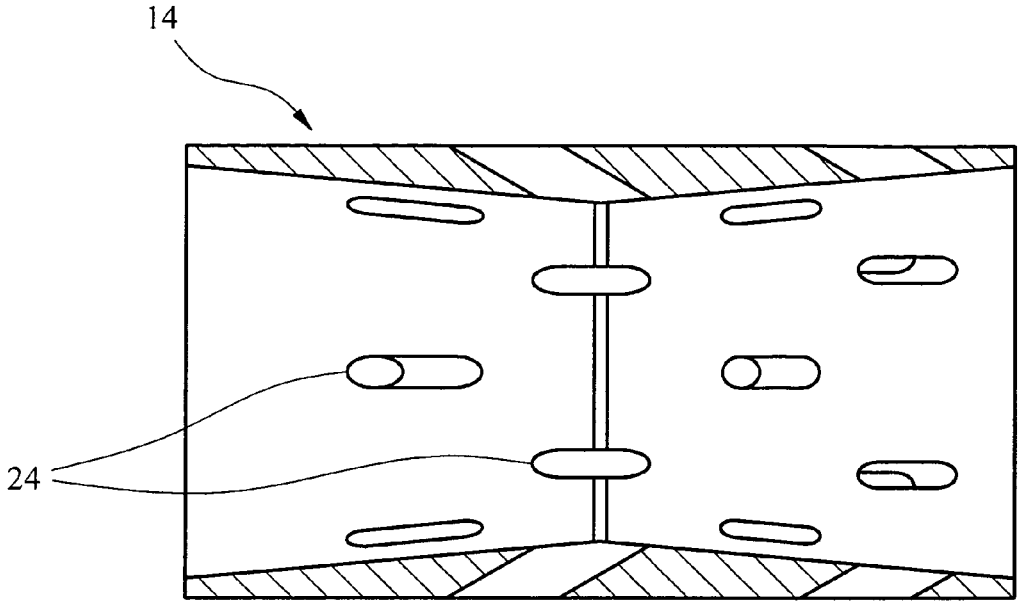
FIG. 1A is a side cross sectional view of plug housing for a pressure barrier apparatus embodying the present invention.
Figure 1B:
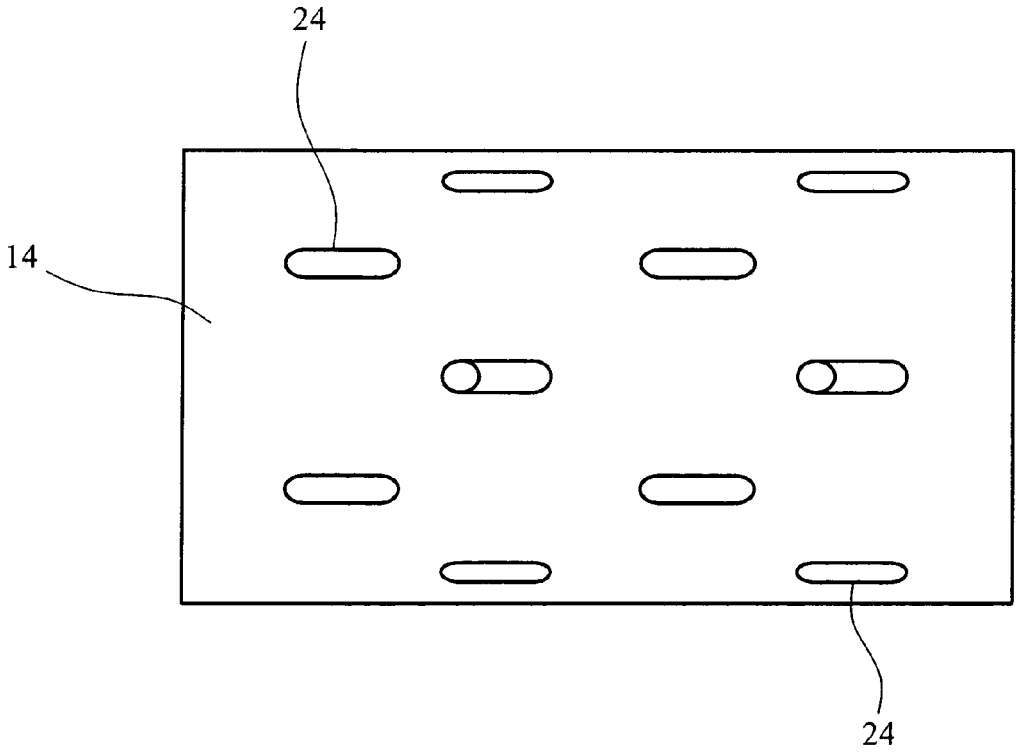
FIG. 1B is a side view of the plug housing of FIG. 1A.
Figure 2:
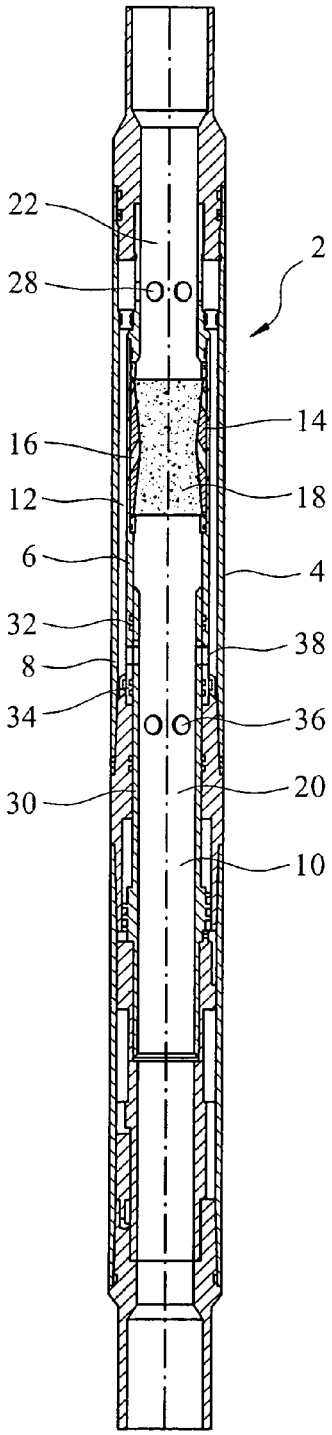
FIG. 2 is a cross sectional side view of a pressure barrier apparatus embodying the present invention, incorporated into a downhole tool and prior to actuation thereof.
Figure 3:
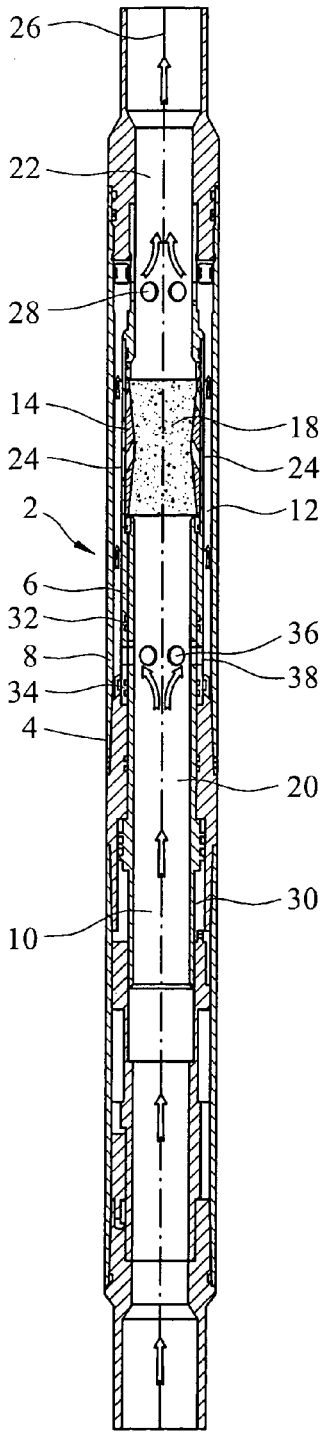
FIG. 3 is a view corresponding to FIG. 2 immediately after actuation of the pressure barrier apparatus.
Figure 4:
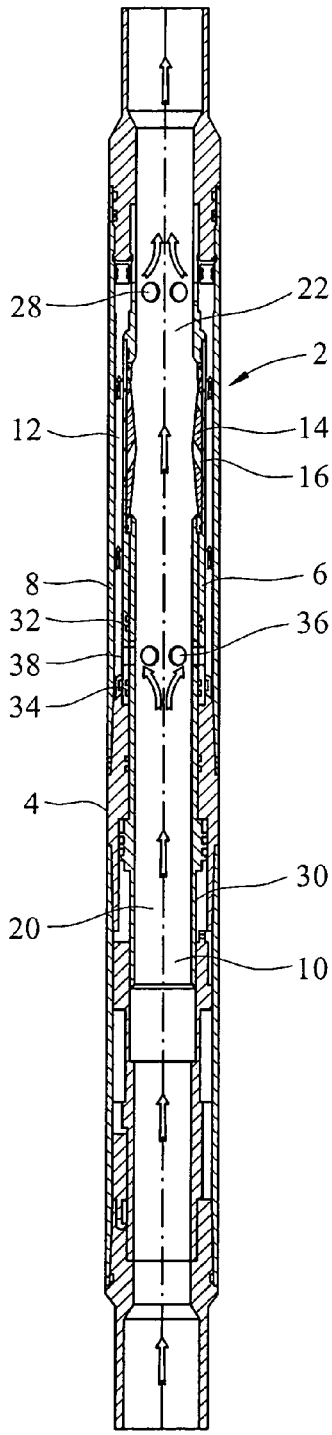
FIG. 4 is a view corresponding to FIG. 2 showing the apparatus of FIGS. 2 and 3 after complete erosion of the pressure barrier member.

Referring to FIG. 2, a pressure barrier apparatus 2 embodying the present invention has a housing 4 having screw threads (not shown) at its ends for enabling the apparatus 2 to be incorporated into a downhole tool. The housing 4 includes an inner housing part 6 and an outer housing part 8. The inner housing part 6 defines a first fluid flow passage in the form of a central bore 10 to enable hydrocarbons to be removed from a well (not shown) in an upward direction as shown in FIGS. 2 to 4.

The inner housing part 6 is located within the outer housing part 8 such that an annular second fluid flow passage 12 is defined between the inner 6 and outer 8 housing parts. A plug housing 14 is located inside the inner housing part 6 and defines a constriction 16 in which an erodeable pressure barrier member 18, formed from sand and a bonding agent, is securely located, such that the central bore 10 is divided into a first part 20 below the pressure barrier member 18 and a second part 22 above the pressure barrier member 18, such that flow from the first part 20 to the second part 22 is prevented by the barrier member 18.

The plug housing 14 is also provided with a series of conduits 24 which are inclined relative to the longitudinal axis 26 of the tool, such that when fluid flows upwards in the annular second fluid flow passage 12, some of the fluid enters the conduits 24 and is directed to the pressure barrier member 18, as a result of which erosion of the pressure barrier member 18 takes place.

The second fluid flow passage 12 is connected to the second part 22 of the central bore 10 by means of a series of apertures 28 in the inner housing part 6. An actuator mechanism includes a sleeve 30 axially slidably located within the inner housing part 6 and having seals 32, 34 located between the inner housing part 6 and the sleeve 30. The sleeve 30 is provided with apertures 36 through its wall, and the inner housing part 6 is provided with apertures 38 for fluid communication with the apertures 36 in the sleeve 30 when the apertures 36 in the sleeve 30 and the apertures 38 in the inner housing part 6 are aligned.

In the position shown in FIG. 2, the apertures 36 in the sleeve 30 and the apertures 38 in the inner housing part 6 are not aligned, and the seals 32, 34 therefore prevent passage of fluid from the first part 20 of the central bore 10 into the second fluid flow passage 12. As a result, fluid flow to the second part 22 of the central bore 10 is prevented by the pressure barrier member 18.

In order to actuate the apparatus, the sleeve 30 is moved upwardly relative to the inner housing part 6, by means of one or more methods which will be known to persons skilled in the art. For example, an on board electronic timer (not shown) is programmed prior to installation of the apparatus 2 in a wellbore. The delay time may be many weeks or months. The timer is controlled by a micro processor, is powered by batteries and has an electronic output which may actuate an electric motor or small explosive pyrotechnic actuator (not shown). The actuator will function following expiry of the programmed delay time and will allow well pressure to communicate to a piston surface of the sleeve 30. An air chamber on the back side of the piston surface will provide the sleeve 30 with a large imbalance when exposed to the well pressure. This force is used to push the pressure barrier sleeve 30 to the open position allowing a flow path to be established around the back of the erodable pressure barrier 18 and through the annular second fluid flow path 12.

Figure 5:
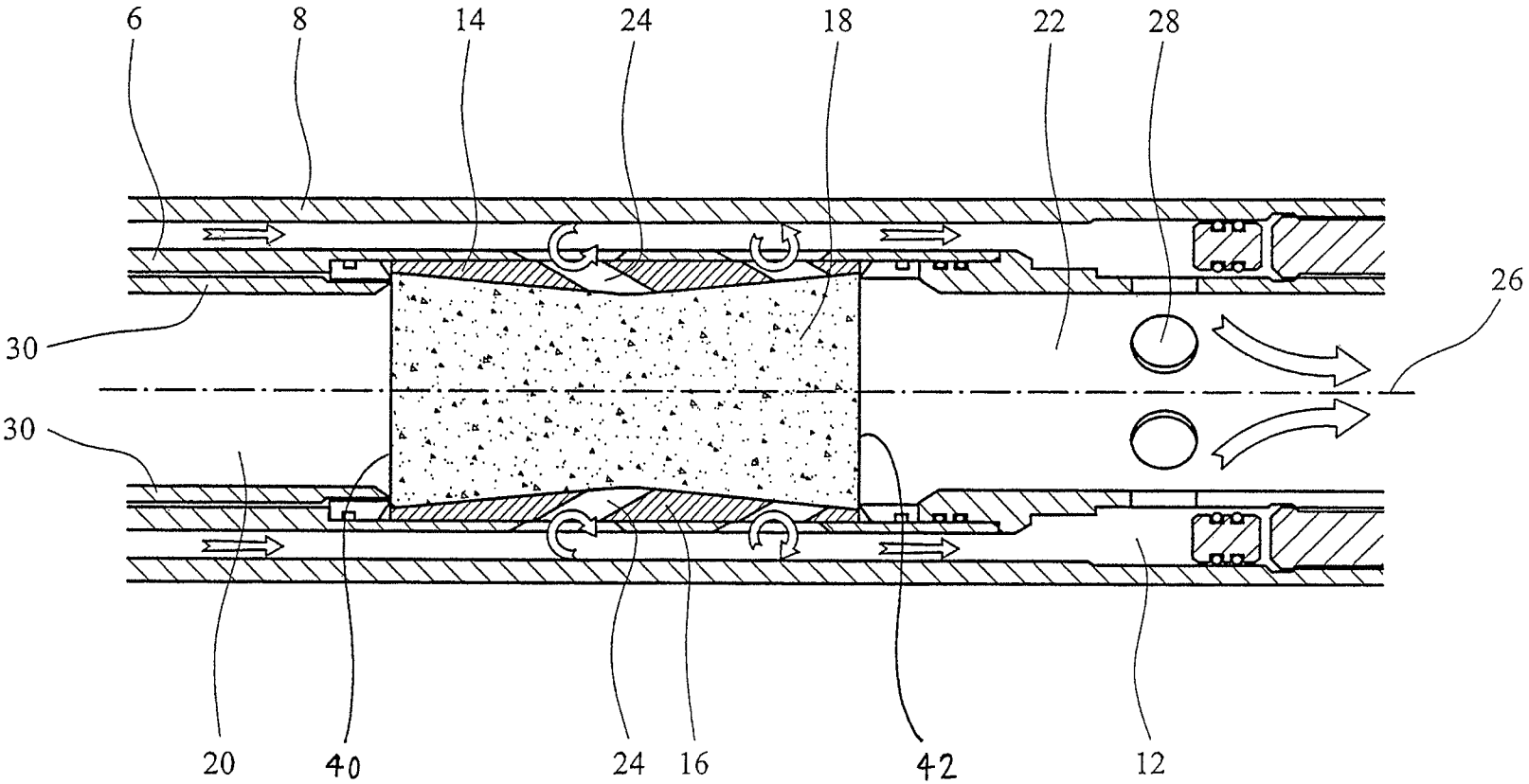
FIG. 5 is an enlarged cross sectional view of the pressure barrier member and plug housing of the apparatus of FIGS. 2 to 4 with flow established after actuation of the apparatus, but prior to any significant erosion of the barrier member.

When this occurs, the apertures 36 in the sleeve 30 become aligned with the apertures 38 in the inner housing part 6, as shown in FIG. 3. As a result, fluid can flow from the first part 20 of the central bore 10, via the annular second fluid flow passage 12, through the apertures 28 into the second part 22 of the central bore 10. At the same time, and as shown in greater detail in FIG. 5, fluid passing along the second fluid flow passage 12 enters the conduits 24 in the inner housing part 6 and is directed into contact with the barrier member 18. Turbulence in the fluid flowing into the conduits 24 and coming into contact with the pressure barrier member 18 causes rapid erosion of the barrier member 18, as a result of which the barrier member 18 eventually disappears, and fluid can flow directly along the central bore 10 from the first part 20 to the second part 22, in preference to being directed through the second fluid flow passage 12. FIG. 5 also shows a sealing membrane 40 which separates the barrier member 18 from the first part 20, and a sealing membrane 42 which separates the barrier member 18 from the second part 22.

In the event of failure of fluid flow in the second fluid flow passage 12 to erode the barrier member 18, for example as a result of blockage of the conduits 24, the barrier member 18 can be eroded by means of fluid flow introduced into the second part 22 of the central bore 10, for example by means of a tube (not shown) introduced into the upper end of the apparatus 2.

It will be appreciated by persons skilled in the art that the above embodiment has been described by way of example only and not in any limitative sense, and that various alterations and modifications are possible without departure from the scope of the invention as defined by the appended claims. For example, instead of causing fluid flow in a second fluid flow passage 12, static fluid can be present in the apparatus 2 when introduced into the borehole, and flow of the fluid can be subsequently caused, bringing flow of the fluid into contact with the barrier member 18 causing erosion and subsequent removal of the barrier member 18.

The invention claimed is:

1. A pressure barrier apparatus for providing a removable pressure barrier in a borehole, the apparatus comprising:

a housing defining a first flow passage having a first part and a second part separated in use by an erodeable pressure barrier member, a second fluid flow passage for connecting said first part to said second part and through which fluid flows from said first part to said second part when the apparatus is actuated, and at least one conduit for directing at least a portion of the fluid flowing in said second fluid flow passage from said first part to said second part onto said barrier member to cause erosion thereof.

2. An apparatus according to claim 1, wherein the housing defines a constriction for receiving the barrier member.

3. An apparatus according to claim 1, wherein at least one said conduit is inclined relative to a longitudinal axis of the housing.

4. An apparatus according to claim 1, wherein at least one said conduit comprises a slot.

5. An apparatus according to claim 1, further comprising an actuator mechanism having a first condition in which fluid communication between said first part and said second fluid flow passage is prevented, and a second condition in which fluid is permitted to flow from said first part to said second fluid flow passage to cause erosion of said barrier member.

6. An apparatus according to claim 5, wherein the actuator mechanism comprises a sleeve having at least one aperture therethrough, wherein the sleeve is moveable between a first position in which fluid communication is established between the first part and the second fluid flow passage via at least one said aperture, and a second position in which fluid flow between the first part and the second fluid flow passage is prevented.

7. An apparatus according to claim 1, further comprising an erodeable barrier member for blocking the first fluid flow passage between said first part and said second part.

8. An apparatus according to claim 7, wherein an external profile of the barrier member matches an internal profile of said constriction.

9. An apparatus according to claim 7, wherein the barrier member comprises sand and a bonding agent.

10. An apparatus according to claim 7, further comprising a sealing membrane separating the barrier member from the first part.

11. An apparatus according to claim 7, further comprising a sealing membrane separating the barrier member from the second part.

* * * * *

UNITED STATES PATENT AND TRADEMARK OFFICE

CERTIFICATE OF CORRECTION

PATENT NO. : 7,703,511 B2
APPLICATION NO. : 11/859060
DATED : April 27, 2010
INVENTOR(S) : Buyers et al.

It is certified that error appears in the above-identified patent and that said Letters Patent is hereby corrected as shown below:

On the title page item (75) Inventors, please add -- Anthony LaPlante, Aberdeen (GB) --

Signed and Sealed this

Fifteenth Day of June, 2010

David J. Kappos

David J. Kappos
*Director of the United States Patent and Trademark Office*